United States Patent [19]

Theobald

[11] 4,024,796

[45] May 24, 1977

[54] FLOAT CONTROL ELECTRICAL CIRCUIT FOR A BLADE

[75] Inventor: Michael R. Theobald, Princeville, Ill.

[73] Assignee: Caterpillar Tractor Co., Peoria, Ill.

[22] Filed: Sept. 24, 1975

[21] Appl. No.: 616,211

[52] U.S. Cl. ..... 91/411 R; 91/437; 91/451; 91/464; 172/795; 172/809

[51] Int. Cl.[2] ..... F15B 11/16; F15B 13/043

[58] Field of Search ..... 137/596.2; 91/437, 464, 91/411 R, 411 B, 451; 172/809, 795, 796, 797

[56] References Cited

UNITED STATES PATENTS

| | | | |
|---|---|---|---|
| 2,179,179 | 11/1939 | Fischel et al. | 91/437 |
| 2,604,074 | 7/1952 | Glenny | 91/437 X |
| 2,909,342 | 10/1959 | Maltby | 91/437 X |
| 3,452,645 | 7/1969 | Barltrop | 91/437 X |
| 3,608,431 | 9/1971 | Pease | 91/437 X |
| 3,630,121 | 12/1971 | Landaeus et al. | 91/437 |
| 3,709,103 | 1/1973 | Gershonovich et al. | 91/437 |

*Primary Examiner*—Irwin C. Cohen
*Attorney, Agent, or Firm*—Phillips, Moore, Weissenberger, Lempio & Majestic

[57] ABSTRACT

In a vehicle, such as a motor grader, having a work tool operated by at least one hydraulic cylinder, the position of the work tool being controlled by a main control valve, and the work tool being placed in a float condition by actuation of a second control valve, the improvement wherein the operator may override the float condition by actuation of the main control valve.

20 Claims, 3 Drawing Figures

FLOAT CONTROL ELECTRICAL CIRCUIT FOR A BLADE

BACKGROUND OF THE INVENTION

A conventional motor grader comprises a blade adapted to be moved and held in a vertically selected position of operation by at least one cylinder. The cylinder is integrated into a fluid circuit, including a main control valve which directs fluid under pressure to the rod or head ends of the cylinder to raise or lower the blade to a desired position, and a lockout valve which is adapted to trap fluid in the rod and head ends of the cylinder so that the blade is held in a semi-rigid selected position on the motor grader during a finish grading operation, for example.

It is oftentimes desirable to employ the blade or other auxiliary work tool mounted on the motor grader for an additional operation, such as snow-removal. In such case, it is then desirable to "float" the blade by providing means in the fluid circuit whereby a degree of reciprocal movement of the blade is allowed by the cylinder.

For example, U.S. Application Ser. No. 560,058, filed on Mar. 20, 1975 by Joseph E. Dezelan for "Blade Lift Float Circuit for Motor Graders" discloses a fluid circuit as above described, for permitting a work tool, such as the blade employed on a motor grader, to be either held in a selected work position or to be placed in a "float" condition of operation by at least one double-acting cylinder. Such application is assigned to the assignee of this application.

In more particular, such application discloses a work tool, at least one double-acting cylinder operatively connected to the work tool for selectively moving the same, a pressurized fluid source, a first control valve connected between the cylinder and the fluid source, the first control valve having a manually operable handle with head end, rod end and neutral positions for communicating fluid from the fluid source through the first control valve to the head or rod ends of the cylinder when the handle is in head end or rod end positions, respectively, and for preventing fluid flow through the first control valve when the handle is in neutral position, a normally closed second control valve connected between the cylinder and the pressure source for exhausting fluid from both the head and rod ends of the cylinder when the second control valve is open, and means including a solenoid for opening the second control valve when the solenoid is energized.

In the operation of a system as disclosed in the above-mentioned U.S. application Ser. No. 560,058, the operator closes a "float" switch to energize the solenoid and move the second control valve to open position so that the work tool will function in "float" mode, as, for example, in a snow-removal operation. If the operator sees an object buried in the road or protruding up in the road which he does not want to hit with the blade he must first open the float switch to take the operation out of the float mode and must then actuate the main control valve to raise the work tool so that it will miss the object. These operations take time and require skill to carry out in the proper sequence, and thus the object is not always missed as intended.

SUMMARY OF THE INVENTION

The principal object of the present invention is to provide an improved electrical circuit for a work tool system, such as disclosed in the above-mentioned U.S. application Ser. No. 560,058, wherein operation in float mode can be immediately interrupted and normal operation restored merely by actuation of the main control valve. Thus, if the work tool is in float mode during a snow-removal operation, and the operator sees an object which the tool is to avoid, all that the operator need do is actuate the main control valve which causes the blade to be immediately moved away from the object.

In more particular, a switch is provided which is actuated by the handle of the main control valve, the switch being closed when the handle is in neutral position and open when the handle is moved from neutral position. The switch is connected in the electrical control circuit so that the float condition can be normally established and maintained only when the handle is in neutral position.

Provision is also made so that a float mode can alternatively be maintained in spite or movement of the main control handle from neutral position.

Other objects and advantages will become apparent in the course of the following detailed description.

BRIEF DESCRIPTION OF THE DRAWINGS

In the drawings, wherein like parts are designated by like reference numerals throughout the same, FIG. 1 schematically illustrates a fluid circuit adapted for use on a motor grader for controlling movements of the blade thereof, and one form of an electrical circuit for controlling the operation of the fluid circuit.

DESCRIPTION OF THE PREFERRED EMBODIMENT

Figure 1:
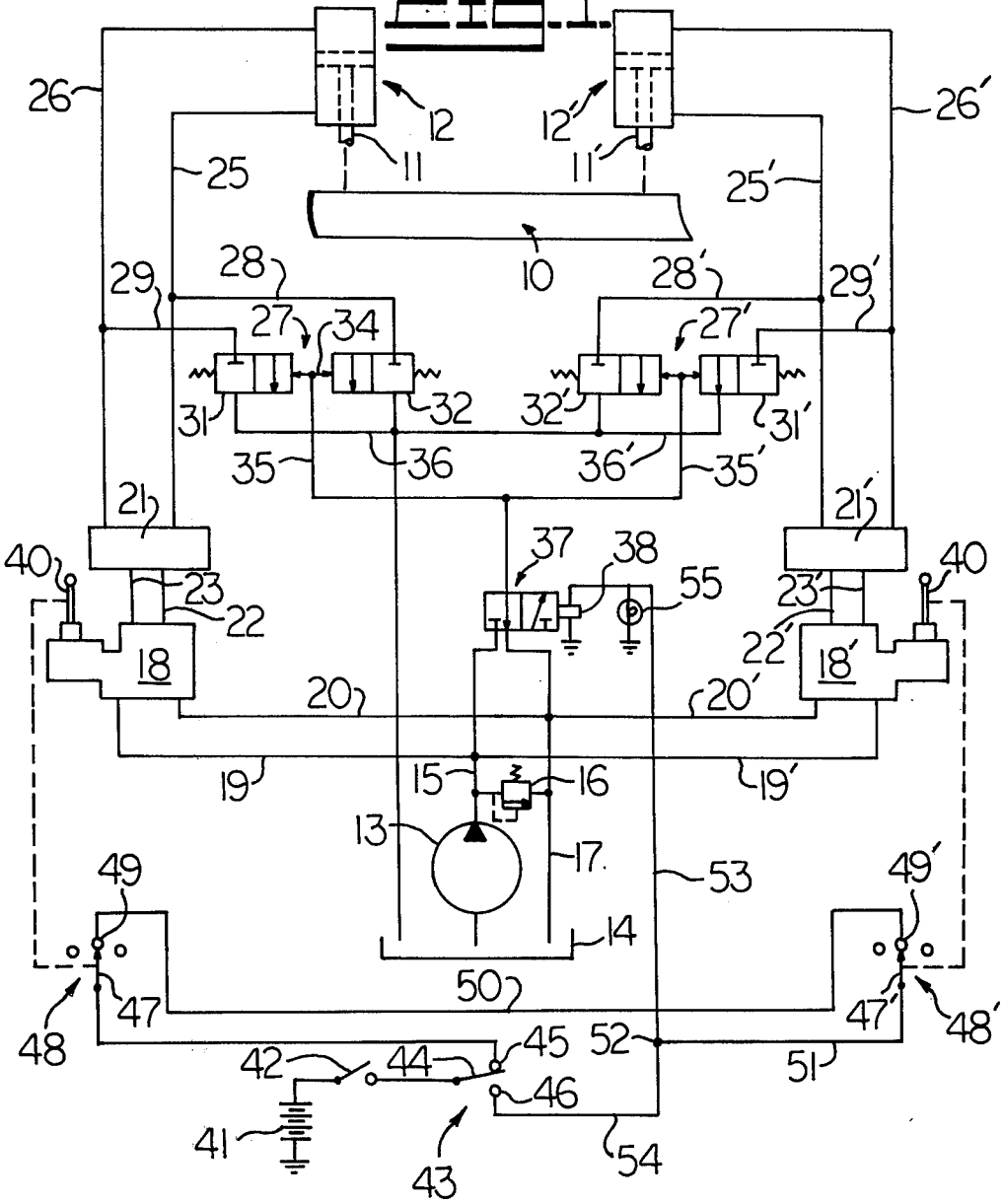

Referring now to FIG. 1, a work tool 10, such as the blade employed on a motor grader, is operatively connected in a conventional manner to rods 11 and 11+ of a pair of double-acting hydraulic cylinders 12 and 12', respectively. Since the cylinders 12 and 12' are actuated by substantially identical components and connections, only those used for actuation of cylinder 12 will be described, it being understood that the description will also describe the corresponding parts, identified by primed reference numberals, used for actuation of cylinder 12'. In addition, although the hereinafter-described fluid and electrical circuits are preferably employed with motor grader blade 10, it should be understood that the invention disclosed and claimed herein is adapted for use on other vehicles and in conjunction with other work tools. Furthermore, although a pair of hydraulic cylinders and attendant circuits are disclosed herein, it will be seen that a single cylinder and attendant fluid and electrical circuits could be utilized, if so desired.

The fluid circuit for controlling the operation of cylinder 12, for example, comprises a pressurized fluid source including an engine-driven pump 13 adapted to draw hydraulic fluid from a tank 14 and pump it through conduit 15. A relief valve 16 is suitably connected between conduit 15 and return conduit 17 to relieve excessive pressures. A main, or first, control valve 18 is adapted to either receive fluid from conduit 19, connected to conduit 15, or to return exhausted fluid via conduit 20 to conduit 17. Valve 18 is further adapted to communicate fluid to lockout valve means 21 or to receive exhausted fluid therefrom via conduits 22 and 23 in a conventional manner.

Lockout valve means 21, functioning to selectively block communication of fluid from cylinder 12 to first control valve means 18, is operatively connected to the rod and head ends of the cylinder by conduits 25 and 26, respectively. The rod and head ends of cylinder 12 are further connected to a normally closed second control valve means 27 by conduits 28 and 29, respectively. Valve means 27 comprises a pair of back-to-back pistons 31 and 32. When pressure at chamber 34, between the pistons, from conduit 35 is present, the pistons will move away from each other so that conduits 28 and 29 will both connect to conduit 36 to exhaust fluid from both ends of cylinder 12 to tank 14.

Pressurized fluid is selectively directed to chamber 34 from the pressurized fluid source through actuation means preferably comprising a solenoid-operated valve 37. Such valve is preferably biased to its illustrated position, wherein conduit 35 is open to tank 14. When solenoid 38 is energized, valve 37 moves to a position wherein conduit 35 is connected to the high-pressure conduit 15.

Thus, whenever solenoid 38 is de-energized, valve 37 will be in its illustrated position, and both halves of valve 27 will be in their spring-biased normally-closed positions. Cylinder 12 will then be under control of the first control valve 21. Control valve 21 is provided with a manually operable handle 40 which actuates valve 21 to lower, raise or hold the blade stationary when the handle is in head end, rod end or neutral position, respectively. When solenoid 38 is energized, second control valve 27 will open to exhaust fluid from both ends of cylinder 12, placing the blade 10 is a "float" mode of operation wherein it is adapted to ride over uneven terrain during a snow-plowing operation, for example.

The electrical control circuit for the above fluid circuit will now be described. A source of electrical potential 41, such as the battery of the vehicle, is connectable to solenoid 38 by means of a manually operable, normally open "float" switch 42 and a manually-operable mode switch 43 connected in series. Mode switch 43 has two closed positions, the one illustrated wherein the switch blade 44 engages contact 45 and the other wherein switch blade 44 engages contact 46. When the float switch 42 is closed and mode switch 43 is in the illustrated position, a circuit from battery 41 will be complete to the switch blade 47 of switch 48. Switch blade 47 is ganged to the manually operable handle 40 of the first control valve 18 for movement thereby, and switch blade 47 will be in engagement with contact 49 only when handle 40 is in neutral position. When so engaged, a circuit will be completed through switch blade 47, contact 49 and wire 50 to contact 49' of switch 48'. When manually operable handle 40' of control valve 18' is in neutral, the circuit will be completed through switch blade 48', wire 51, junction 52 and wire 53 to solenoid 38.

Thus, when it is desired to go into float operation, the operator closes the float switch 42. If the handle-actuated switches 48 and 48' are both closed, or, as soon as both handles 40 and 40' are moved to neutral position, solenoid 38 will be energized so that the fluid control system will put the blade 10 in float. Since switches 42, 48 and 48' are all in series between the battery and solenoid, opening of any one of the switches will de-energize the solenoid. Thus, if the operator actuates one, or both, of the handles 40 and 40' to raise the blade, the solenoid 38 will be de-energized to take the blade out of float and the blade will be immediately raised. After the obstacle has been passed, the operator will actuate the handles 40 and/or 40' to lower the blade and will then return the handles to neutral position. Such return again completes the energizing path to solenoid 38 and the system automatically goes back into float operation.

At times it may be desirable to place the system in float operation and not have such operation affected by movement of the handles 40 or 40'. In such case, the mode switch is moved to its other closed position. As long as the float switch 42 is closed, an energizing circuit is formed continuously through mode switch blade 44, contact 46, wire 54, junction 52 and wire 53 to solenoid 38. Switches 48 and 48' no longer have any effect on the float operation when in this mode.

Indicator light 55 is connected in parallel with solenoid 38 and gives the operator a visual indication whenever the float circuit is in operation.

Figure 2:
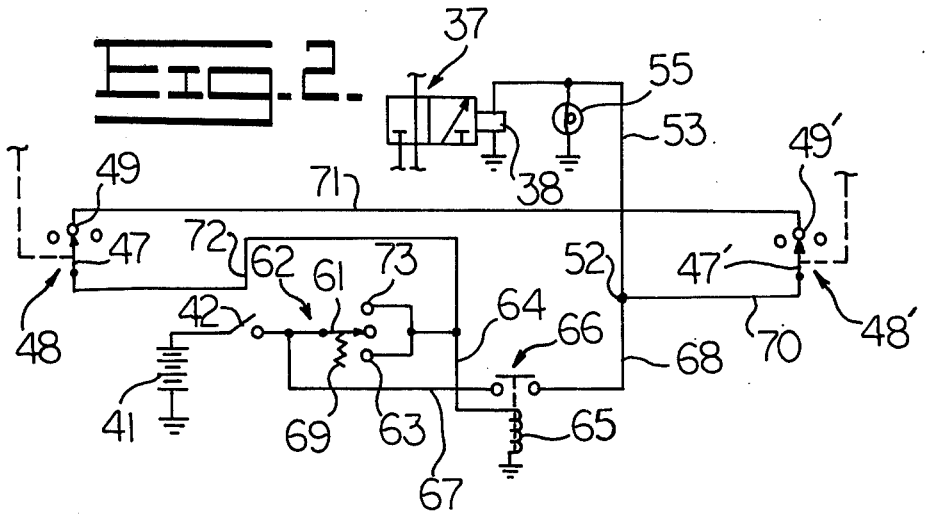
FIG. 2 illustrates another form of an electrical circuit for controlling the operation of the fluid circuit of FIG. 1.

In the event an electrical control system is desired which will allow the operator to take the system out of float upon operation of one of the control valve handles but which will not automatically revert to float when the control handles are returned to neutral, an electrical control system such as shown in FIG. 2 may be used. In this system closure of the float switch 42 will supply electrical energy to switch blade 61 of mode switch 62. The operator now manually moves switch blade 62 into engagement with contact 63 to complete, through wire 64, an energizing path to relay coil 65. Energization of this coil causes relay contacts 66 to close, completing an energizing circuit through wire 67, relay contacts 66, wire 68, junction 52 and wire 53 to solenoid 38. The operator may now release the mode switch blade 61 which is returned to the illustrated open position by spring 69. Relay coil 65 is maintained energized by the holding circuit established from junction 52 through wire 70, switch 48', wire 71, switch 48, wires 72 and 64 to relay coil 65.

The float circuit may be interrupted by opening either or both switches 48 and 48' in response to movement of the handles from neutral position. Such opening breaks the holding circuit for relay coil 65, and the reopening of relay contacts 66 causes solenoid 38 to be de-energized. Since the holding circuit is energized through relay contacts 66, the relay coil 65 will not be re-energized after the handles 40 and 40' are both restored to neutral position. In order to return to float operation the operator must again manually close mode switch 62 as described above.

Mode switch 62 also has a second closed position, wherein switch blade 61 may be moved into engagement with contact 73. If so moved, the switch blade will remain in engagement with contact 73 until the switch blade is manually moved therefrom. When in the second closed position, relay coil 65 will be continuously energized, whether switches 48 or 48' are open or closed, and soleenoid 38 will be continuously energized. Thus, this mode of float operation allows float operation to be maintained in spite of an accidental movement of either control valve handle from neutral position.

There may also be conditions wherein it is desirable that a work tool be arranged so that each end of the tool can be separately adjusted and separately put in float condition. For example, a work condition might prevail wherein the operator wishes to control the depth of the blade on one side while allowing the other side to float and follow the contour of the ground. In such event, a system as shown in FIG. 3 would be desirable.

Figure 3:
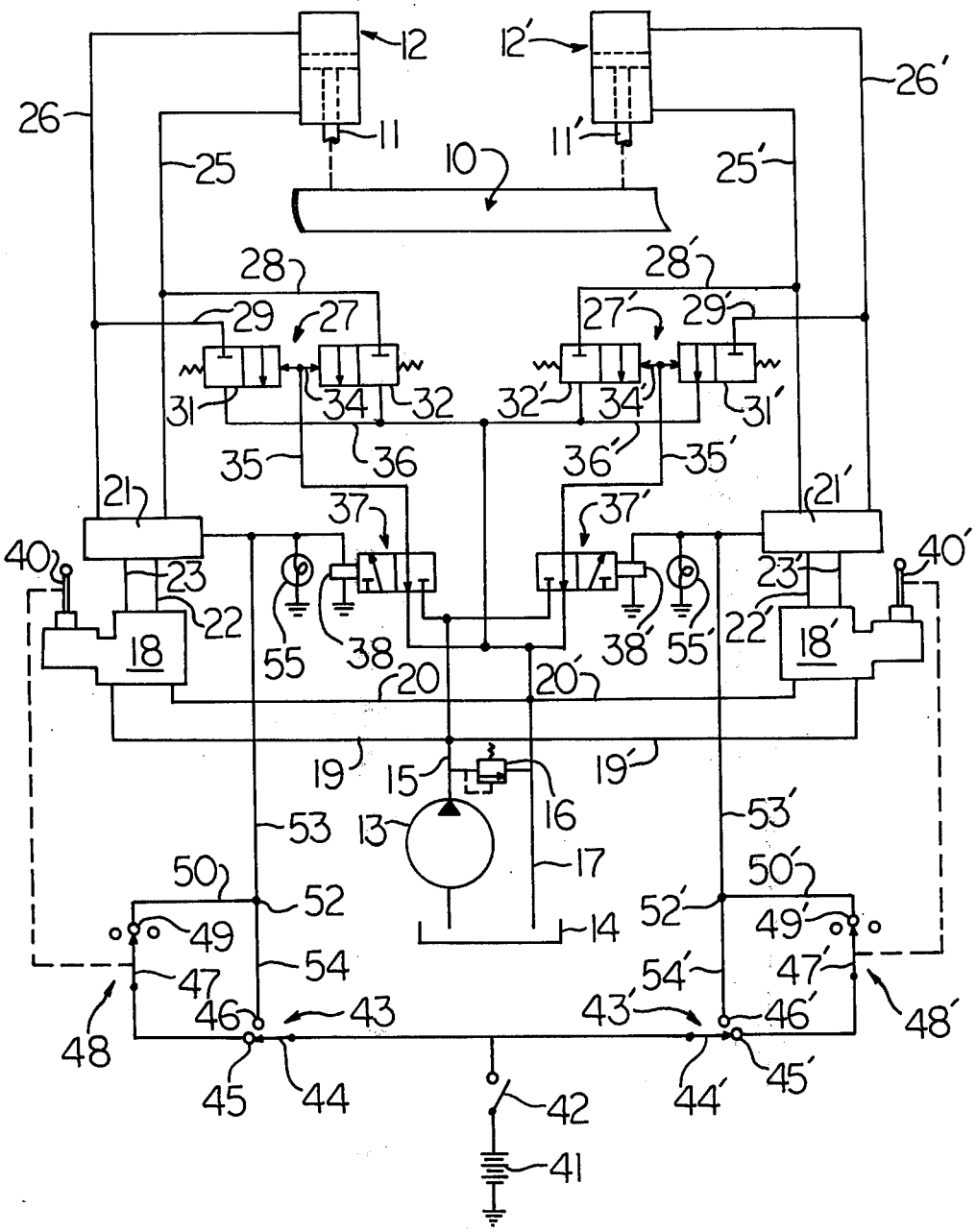
FIG. 3 schematically illustrates another fluid circuit adapted for use on a motor grader wherein either or both ends of the blade may be placed in float mode, and an electrical circuit for controlling the operation of the fluid circuit.

The fluid system of FIG. 3 is essentially the same as that of FIG. 1, except that two solenoid-operated valves 37 and 37' are used. Valve 37 is arranged so as to supply fluid under pressure from pump 13 to control valve 27 alone, while valve 37' supplies fluid under pressure to control valve 27' alone. Thus, if solenoid 38 is energized, cylinder 12 alone is placed in float. If solenoid 38' is energized, cylinder 12' alone is placed in float. If both solenoids are energized, full float is obtained.

The electrical control for solenoid 38 of FIG. 3 is also essentially the same as that of FIG. 1, except that switch 48' is not here utilized in the energizing path for solenoid 38. Instead, a separate energizing path for relay 38' is provided, utilizing switch 48'.

In view of the previous description of FIG. 1, it is believed apparent that the system of FIG. 3 provides an arrangement whereby when the float switch 42 is closed, and the mode switch blades 43 and 43' are closed in engagement with their contacts 45 and 45', solenoids 38 and 38' will be energized when, and only when, the switches 48 and 48' associated therewith are closed. Thus, movement of only one handle 40 or 40' from neutral position will take only that side of the blade out of float. Movement of that handle back to neutral position will restore that side of the blade to float operation.

Movement of the mode switches to their other closed positions, i.e., in engagement with contacts 46 and 46', will retain the blade in float condition regardless of what the operator might do with the control handles.

What is claimed is:

1. In a system having a work tool adapted to be mounted on a vehicle, a doubleacting cylinder operatively connected to said work tool for selectively moving the same, a pressurized fluid source, a first control valve connected between said cylinder and said source, said first control valve having a manually operable handle with head end, rod end and neutral positions for communicating fluid from said source through said first control valve to the head or rod ends of said cylinder when said handle is in head end or rod end positions, respectively, and for preventing fluid flow through said first control valve when said handle is in neutral position, a normally closed second control valve connected between said cylinder and said source for exhausting fluid simultaneously from both the head and rod ends of said cylinder when said second control valve is open, solenoid means, and means operatively associated with said solenoid means and said second control valve for opening said second control valve upon energization of said solenoid means, the improvement comprising:

a. a source of electrical potential, b. a manually operable switch means having a closed position, c. means for electrically connecting said source of electrical potential to said solenoid means to energize said solenoid means in response to movement of said manually operable switch means to closed position, d. means responsive to movement of said manually operable handle from neutral position for opening the electrical connection established by said means (c) from said source to said solenoid means.

2. The system of claim 1 wherein said means (d) includes a switch actuated by said handle, said switch being closed when said handle is in neutral position only, said switch when closed being connected to said source of electrical potential for current flow therethrough when said source is electrically connected to said solenoid means by said means (c).

3. The system of claim 2, wherein said handle-actuated switch is electrically connected in series with said manually operable switch means and said solenoid means.

4. The system of claim 3, wherein said manually operable switch has two closed positions, said manually operable switch being connected in series with said handle-actuated switch when said manually operable switch is in one of its closed positions and being connected across said handle-actuated switch when said manually operable switch is in its other closed position.

5. The system of claim 2, wherein said means (c) includes relay contacts in the electrical connection from said source to said solenoid means and a relay coil for closing and opening said relay contacts upon energization and de-energization of said relay coil, respectively, said relay coil being connected to said source through said manually operable switch means when said manually operable switch means is closed, and wherein said means (d) includes an electrical connection from said relay coil to said source through said handle-operated switch and other than through said manually operable switch means.

6. The system of claim 5 wherein said manually operable switch has two closed positions and spring return means for biasing said switch against closing to one of said closed positions.

7. In a system having a work tool adapted to be mounted on a vehicle, first and second double-acting cylinders operatively connected to said work tool for selectively moving the same, a pressurized fluid source, means including a first control valve connected between said first cylinder and said source, said first control valve having a manually operable handle with head end, rod end and neutral positions for communicating fluid from said source through said first control valve means to the head or rod ends of said first cylinder when said handle is in head end or rod end positions, respectively, and for preventing fluid flow through said first control valve when said handle is in neutral position, means including a normally closed second control valve means connected between said first cylinder and said source for simultaneously exhausting fluid from both the head and rod ends of said first cylinder when said second control valve means is open, means including a third control valve connected between said second sylinder and said source, said third control valve having a manually operable handle with head end, rod end and neutral positions for communicating fluid from said source through said third control valve to the head and rod ends of said second cylinder when said handle is in head end or rod end, respectively, and for preventing fluid flow through said third control valve when said handle thereof is in neutral position, means including a normally closed fourth control valve means connected between said second cylinder and said source for simultaneously exhausting fluid from both the head and rod ends of said second cylinder when said fourth control valve means is open, valve opening means operatively associated with said second and fourth control valve means for opening said control valve means when the valve opening means associated therewith is actuated, solenoid means opertively associated with said valve opening means for actuating said valve opening means when said solenoid means is energized, the improvement comprising:

a. a source of electrical potential, b. manually operable switch means having a closed position, c. means for electrically connecting said source of electrical potential to said solenoid means in response to movement of said manually operable switch means to closed position to energize the solenoid means operatively associated with the valve opening means for opening both of said second and fourth control valve means, d. means responsive to movement of said first manually operable handle from neutral position for opening the electrical connection established by said means (c) from said source to said solenoid means operatively associated with said valve opening means operatively associated with said second control valve means and responsive to movement of said second manually operable handle from neutral position for opening the electrical connection established by said means (c) from said source to said solenoid means operatively associated with said valve opening means operatively associated with said fourth control valve means.

8. A system as set forth in claim 7 wherein said means (d) includes a first switch actuated by said handle of said first control valve, said switches being closed when the handles are in neutral position only, said switches when closed being connected to said source of electrical potential for current flow therethrough when said source is electrically connected to said solenoid means by said means (c).

9. A system as set forth in claim 8 wherein said means (c) includes relay contacts in the electrical connection from said source to said solenoid means and a relay coil for closing and opening said relay contacts when said relay coil is energized and de-energized respectively, said relay coil being connected to said source through said manually operable switch means when said manually operable switch means is closed, and wherein said means (d) includes an electical connection from said relay coil to said source through at least one of said handle-actuated switches and other than through said manually operable switch means.

10. The system of claim 9, wherein said manually operable switch means comprises a switch having two closed positions and spring return means for biasing said switch against closing to one of said closed positions.

11. The system of claim 8 wherein said handle-actuated switches are connected to said source of electrical potential for flow therethrough of the current flowing through said solenoid means from said source.

12. The system of claim 8 wherein said solenoid means comprises a single solenoid operatively associated with said valve opening means for opening both said second and fourth control valve means, the improvement further being that said first and second handleactuated switches are connected in series with each other.

13. The system of claim 12 wherein said means (c) includes relay contacts in the electrical connection from said source to said solenoid means, and a relay coil for closing and opening said relay contacts when said relay coil is energized and de-energized respectively, said relay coil being connected to said source through said manually operable switch means when said manually operable switch means is closed, and wherein said means (d) includes an electrical connection from said relay coil to said source through both of said handle-actuated switches and other than through said manually operable switch means.

14. The system as set forth in claim 13 wherein said manually operable switch means comprises a switch having two closed positions and spring return means for biasing said switch against closing to one of said positions.

15. The system as set forth in claim 12 wherein said first and second handle-actuated switches are connected in series with each other and with said manually operable switch means.

16. The system as set forth in claim 15 wherein said manually operable switch means comprises a switch having two closed position, said manually operable switch being connected in series with said first and second handle-actuated switches when said manually operable switch is in one of its closed positions and being connected across said first and second handle-actuated switches when said manually operable switch is in its other closed position.

17. The system of claim 7 wherein said valve opening means includes first and second portions independently associated with said second and fourth control valve means for independent opening of said control valve means and wherein said solenoid means comprises a first solenoid operatively associated with said first portion of said valve opening means and a second solenoid operatively associated with said second portion of said valve opening means, the improvement further being that said means (c) connects said source of electrical potential separately to both of said first and second solenoids of said solenoid means, and wherein said means (d) includes a first switch actuated by said handle of said first control valve and a second switch actuated by said handle of said third control valve, said switches being closed when the handles are in neutral position only, said first handle-actuated switch being connected to said source for current flow therethrough when said source is electrically connected to said first solenoid by said means (c) and said second handle-actuated switch being connected to said source for current flow therethrough when said source is electrically connected to said second solenoid by said means (c).

18. The system of claim 7 wherein said first handle-actuated switch is connected in series with said source and said first solenoid and wherein said second handle-actuated switch is connected in series with said source and said second solenoid.

19. The system of claim 18 and further including means operatively associated with said manually operable switch means for completing electrical circuits across said first and second handle-actuated switches.

20. The system of claim 18 wherein said manually operable switch means comprises first and second manually operable switches each having two closed positions, said first manually operable switch being connected in series with said first handle-actuated switch when said first manually operable switch is in one of its closed positions and being connected across said first handle-actuated switch when said first manually operable switch being connected in series with said second handle-actuated switch when said second manually operable switch is in one of its closed positions and being connected across said second handle-actuated switch when said second manually operable switch is in its other closed position.

* * * * *

UNITED STATES PATENT OFFICE

CERTIFICATE OF CORRECTION

Patent No. 4,024,796 Dated May 24, 1977

Inventor(s) Michael R. Theobald

It is certified that error appears in the above-identified patent and that said Letters Patent are hereby corrected as shown below:

At column 7, and in line 3 of claim 8, --and a second switch actuated by said handle of said third control valve-- should be inserted after "valve" and before the comma (,).

Signed and Sealed this

*Tenth* Day of *February 1981*

[SEAL]

*Attest:*

RENE D. TEGTMEYER

*Attesting Officer*

*Acting Commissioner of Patents and Trademarks*